US006185909B1

(12) United States Patent
Schölzke et al.

(10) Patent No.: US 6,185,909 B1
(45) **Date of Patent: *Feb. 13, 2001**

(54) METHOD FOR PACKAGING A MATERIAL WEB ROLL

(75) Inventors: Volker Schölzke, Krefeld; Jakob Hannen, Willich, both of (DE); Jozef-Franc Zajec, Velden (NL); Frank Rostek, Meerbusch (DE); Hans-Josef Peters, Kleve (DE); Udo Ticheloven, Wesel (DE)

(73) Assignee: Voith Sulzer Finishing GmbH, Krefeld (DE)

( * ) Notice: Under 35 U.S.C. 154(b), the term of this patent shall be extended for 0 days.

This patent is subject to a terminal disclaimer.

(21) Appl. No.: 08/991,647

(22) Filed: Dec. 16, 1997

(30) Foreign Application Priority Data

Dec. 17, 1996 (DE) ..... 196 52 447

(51) Int. Cl.[7] ..... B65B 51/06; B65B 11/04
(52) U.S. Cl. ..... 53/419; 53/465
(58) Field of Search ..... 53/465, 476, 480, 53/137.2, 211, 214, 215, 419

(56) References Cited

U.S. PATENT DOCUMENTS

| | | | | |
|---|---|---|---|---|
| 2,872,767 | | 2/1959 | Clem . | |
| 2,893,191 | * | 7/1959 | Lancaster | 53/214 X |
| 3,863,425 | | 2/1975 | Edwards et al. . | |
| 3,928,939 | | 12/1975 | Edwards et al. . | |
| 5,983,606 | * | 11/1999 | Hannen et al. | 53/465 |

FOREIGN PATENT DOCUMENTS

| | | |
|---|---|---|
| 0765809 | 4/1997 | (EP) . |
| 19535746 | 4/1997 | (DE) . |
| 750561 | 6/1956 | (GB) . |
| 1429445 | 3/1976 | (GB) . |
| 95/12528 | 5/1995 | (WO) . |

* cited by examiner

*Primary Examiner*—Linda Johnson
(74) *Attorney, Agent, or Firm*—Greenblum & Bernstein, P.L.C.

(57) ABSTRACT

A method for packaging a web roll, where a packaging sheet is wrapped in a helical line around the web roll, in order to create a body packaging, and where the packaging sheet is wrapped in the circumferential direction around the web roll at the beginning and/or end of the web roll, to form a substantially uniformly shaped axial projection during creation of end packaging.

11 Claims, 1 Drawing Sheet

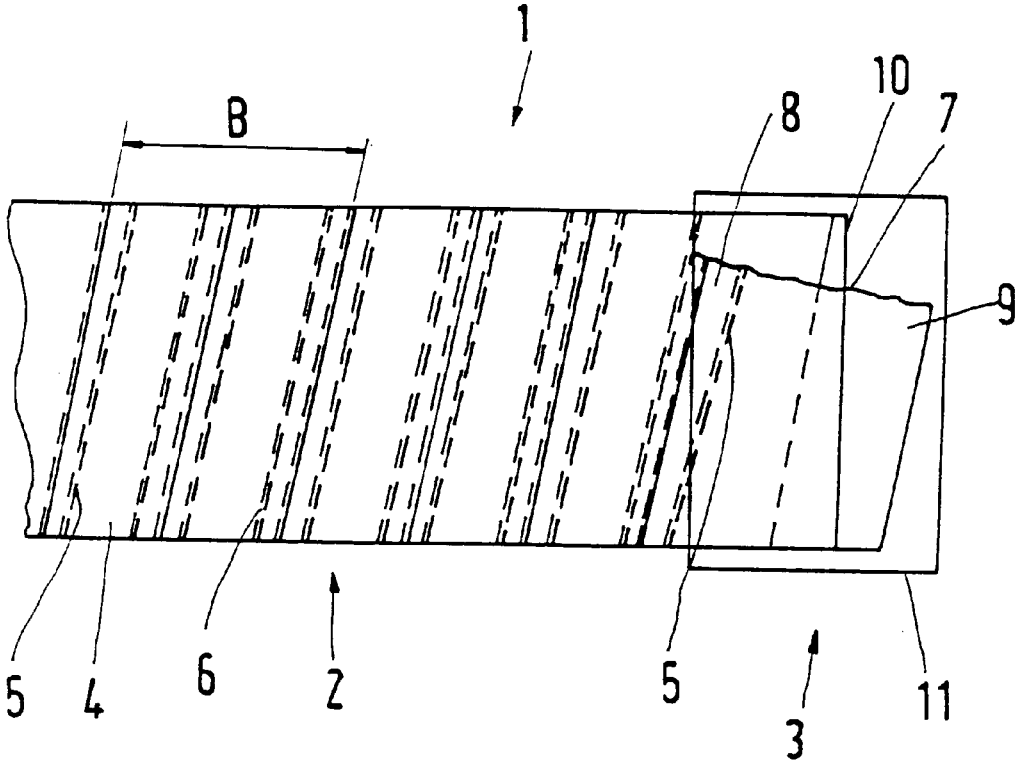
1
B
8
10
7
9
5
4
6
2
5
3
11

METHOD FOR PACKAGING A MATERIAL WEB ROLL

CROSS-REFERENCE TO RELATED APPLICATION

The present invention claims the priority under 35 U.S.C. § 119 of German Application No. 196 52 447.4 filed Dec. 17, 1996, the disclosure of which is expressly incorporated by reference herein in its entirety.

BACKGROUND INFORMATION

1. Field of the Invention

The invention relates to a method for packaging a web roll where a packaging sheet is wound around the web roll in a helical line, in order to create a body packaging, and where the packaging sheet is wound around the web roll in the circumferential direction at the beginning and/or end of the web roll, to form an essentially uniformly shaped axial projection during creation of end packaging.

2. Discussion of Background Information

A method of this type for packaging a web roll is shown in publication DE 195 35 746 A1.

This method of packaging has the advantage that a single supply roll is sufficient, regardless of the width of the web roll being packaged. Hence, various widths of packaging sheet are no longer unnecessary. Body packaging is formed over the axial length of the web roll. With conventional packaging techniques with end face covers, an inner face cover is placed on each of the face sides of the web roll, an axial projection of the packaging sheet is wrapped on the face cover, and an outer face cover is placed and secured on the wrapped projection and inner face cover. In order to use conventional packaging techniques with end face covers, one must complete the helical body packaging along with at least one end packaging, such that the packaging sheet is wound around the web roll in the circumferential direction while creating an axial projection. The width extension of the packaging sheet lies parallel to the axis of the web roll, while during the production of the body packaging, it runs at an oblique angle to the axis of the web roll.

In the production of the body packaging, there occasionally is a problem where the end of the packaging sheet does not adhere to the circumference of the web roll with the required degree of reliability. This occurs in particular when, for whatever reason, glue is not applied up to the edge of the packaging sheet, but rather at a certain distance from the edge. While this is not a serious problem for the outer end of the packaging sheet protruding axially over the web roll, because there is no web roll here anyway on which the packaging sheet could be secured, for the axial inner end of the packaging sheet this can lead to end packaging not being sufficiently secured, and thus becoming loosened. In the subsequent handling of the packaged web roll, this could lead to damage.

SUMMARY OF THE INVENTION

To create a packaging which is less sensitive to damage of this type, the present invention provides a method for packaging a web roll where, during the creation of body packaging, the packaging sheet is guided with its axial outer end projecting over the end of the web roll so that the axial inner end of the packaging sheet is covered by end packaging, during the subsequent creation of the end packaging.

Even when, at the end of the packaging sheet, the end which lies axially on the inside (i.e., the "inner tip") is not glued with the required degree of reliability on the circumference of the web roll, or on a previous winding of the packaging sheet, it will be held reliably on the web roll because it is covered by end packaging. The packaging sheet of the web roll no longer can be damaged by this tip becoming loose and beginning to tear the packaging sheet. However, this procedures requires that the packaging sheet used to create body packaging also project axially a certain distance over the end face of the web roll. This involves only a single layer of the packaging sheet, which would not pose an appreciable problem during subsequent wrapping of the end packaging projection. Further, compared with the relatively large circumferential area being wrapped, the axial projection has a relatively slight axial extension. Further, this projection can be taken into account when it is intended to store the packaged web rolls on top of one another in a tower or chimney stack.

A preferred embodiment provides that an axial inner end of the packaging sheet of the body packaging is in an area which is covered by an axial inner edge strip of the end packaging sheet with a width of about 20% of the maximum width of the packaging sheet. This ensures that the inner tip of the body packaging is, indeed, covered. However, this covering is in the vicinity of the axial inner end of the end packaging, so that the axial projection of the body packaging can be kept small. This saves packaging material.

It is also preferred that the end of the body packaging be completely covered by the end packaging. This simplifies subsequent wrapping of the axial projection of the end packaging. It also ensures that there is no danger of another tip being formed axially on the outside of the body packaging, which could lead to damage. It is preferred that the axially projecting end of the body packaging be kept free of glue. Since the axial projecting end of the body packaging is wrapped on the face of the web roll, there is a danger that the packaging sheet of the body packaging can get on the face of the web roll if it is not completely covered, for example, by an inner face cover. If the axial projection of the body packaging is kept free of glue, this danger does not exist.

It also is preferred for glue to be applied in a number of strips running parallel, such that at least one strip on the axial projection ends sooner than the others. This ensures that the packaging sheet can be reliably glued to the web roll, at least axially further inside. The projection, however, remains glue free.

According to another embodiment, a glue which air-dries after a predetermined period of time is used, and the axial projection of the end packaging is wrapped on the face only after this time has elapsed. When the glue dries in the air, it loses its ability to stick. Wrapping is then possible without danger, because the axial projection is no longer adhering to the face.

It is preferred that the drying time be at least as great as the time required to create end packaging at both ends of the web roll. When the axial projection is wrapped only after the end packaging has been completely produced, this time will have elapsed anyway. Hence, no additional idle time results which could slow down the packaging process.

The present invention provides a method for packaging a web roll having first and second ends and a longitudinal axis, and includes guiding a packaging sheet at an angle oblique to the longitudinal axis where the packaging sheet has an end with an outer tip and an inner tip, positioning the outer tip beyond the first end of the web roll to form an axial tip projection, wrapping the packaging sheet in a helical line around the web roll to form body packaging, and wrapping the packaging sheet in a circumferential direction around the first end of the web roll to form end packaging that covers the inner tip and has a substantially uniformly shaped axial projection. The method may further include wrapping the packaging sheet in a circumferential direction around the second end of the web roll to form end packaging that has a substantially uniformly shaped axial projection. Further, an inner edge of the end packaging may extend longitudinally inside the inner tip by a width of up to about 20 percent of the width of the packaging sheet. Moreover, the end packaging may completely cover the outer tip of the packaging sheet.

The method for packaging a web roll according to the present invention may include preparing the axial tip projection to be free of glue. This method may further involve applying glue in several parallel strips on the packaging sheet, wherein the glue strips not being applied in the vicinity of the axial tip projection. Alternatively, the method may include applying a glue that dries in air after a predetermined period of time on the axial tip projection, and wrapping the axial tip projection on a face of the web roll only after the predetermined period of time has elapsed. This predetermined period of time may be at least as long as the time required to form the end packaging on the first and second ends of the web roll. The method may also include positioning the inner tip of the packaging sheet on the web roll.

It goes without saying that the aforementioned and following characteristic features can be used not only in the described combinations, but also in other combinations or alone, without leaving the scope of the invention. Further embodiments and advantages can be seen from the detailed description and the accompanying FIGURE.

BRIEF DESCRIPTION OF THE DRAWING

The present invention is further described in the detailed description which follows, in reference to the noted drawing by way of non-limiting examples of preferred embodiments of the present invention, wherein:

the FIGURE shows a packaged web roll according to the present invention.

DETAILED DESCRIPTION OF THE INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

The FIGURE shows packaged web roll 1. Web rolls of this type are created, for example, in the production of paper or textile-ware sheets. They have a considerable size. Their diameters are in the range of about 0.5 m to about 2.5 m, and their axial length are in the range of about 0.5 to about 3.8 m or even larger.

Only an axial end of web roll 1 is shown. Web roll 1 is provided with a body packaging 2 along its length. In addition, end packaging 3 is placed on its axial end. In the FIGURE, end packaging 3 is depicted with a somewhat larger diameter than that of the web roll for reasons of clarity. In actuality, end packaging 3 is placed on the circumference of web roll 1.

Body packaging 2 and end packaging 3 are produced from the same packaging sheet 4. This packaging sheet consists of packing paper having a width of at least 350 mm. An axial projection 11 of between about 100 mm to about 150 mm can thus be created on the end of web roll 1. A packaging sheet width of approximately 500 mm has proven effective.

To make body packaging 2, packaging sheet 4 is wrapped in a helical line around web roll 1. The packaging sheet has a width B. The angle of the helical line is set in such a way that the layers of packaging sheet 4 overlap each other in the present embodiment by B/2. In this manner, a two-layered body packaging 2 is created. Of course, other relationships between width B and the angle can be selected, so that multiple layers, for example three or four layers of body packaging 2, can be produced. In the FIGURE, the overlap is illustrated by the fact that each right edge of packaging sheet 4 is shown in the drawing as a line of dashes. It is thus covered by the following layer of the packaging sheet.

Packaging sheet 4 is provided with glue beads in the vicinity of its edges 5, 6, with a nearly linear application of glue. During the production of body packaging, it is glued along its entire length with the web roll, or with the previously placed layer of packaging sheet 4.

Packaging sheet 4 ends at cut or separation line 7. There, on the axial inner end, an inner tip 8 is created, and on the axial outer end, an outer tip 9 is created. Outer tip 9 lies in an area of packaging sheet 4 which projects axially over the face 10 of the web roll 1.

End packaging 3 consists of at least one layer, and usually of several layers of packaging sheet 4, which are wound around the web roll 1 in the circumferential direction when creating axial projection 11.

The end of packaging sheet 4 of body packaging 2, that is, the location of cut or separation line 7, is adjusted relative to the location of end packaging 3, such that cut or separation line 7 is completely covered by end packaging 3. This ensures that inner tip 8 is covered by end packaging. It can be seen in the FIGURE that glue beads 5 are arranged in the vicinity of the edge of packaging sheet 4, but are still removed a small distance therefrom. This leads to the possibility of inner tip 8 becoming loosened from web roll 1. However, since end packaging 3 covers inner tip 8, this danger is eliminated.

Outer tip 9 also is covered by end packaging 3. Here, too, there no longer is a danger of it protruding, such that it could have been a point of origin for damage.

After production of end packaging 3, axial projection 11 of end packaging 3 is wrapped on face 10 of web roll 1 in a known manner, for example by means of impeller wheels. If necessary, an inner face cover can also be attached.

In order to prevent body packaging 2 from becoming stuck on face 10 while wrapping axial projection 11 on outer tip 9, the glue beads 6 can end before the cut or separation line 7. It can be calculated where glue beads 6 must end so that they do not extend into the vicinity of the axial projection of body packaging 2. An application of glue is no longer necessary in any event in that area, because there is nothing available to which packaging sheet 4 could adhere.

Alternatively, a glue could be used that loses its tackiness, or ability it stick, when it has been exposed to the surrounding atmosphere for a certain period of time. Many glues react in this manner. Since the production of end packaging 3 on both ends of web roll 1 takes a certain amount of time anyway, the corresponding choice of glue can prevent the projection of body packaging 3 from sticking to face 10 of the web roll.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

What is claimed is:

1. A method for packaging a web roll having first and second ends and a longitudinal axis, comprising:

guiding a packaging sheet at an angle oblique to the longitudinal axis, the packaging sheet having an end with an outer tip and an inner tip formed by a separating line, positioning the outer tip beyond the first end of the web roll to form an axial tip projection, helically wrapping the packaging sheet around the web roll to form body packaging, and circumferentially wrapping a separate piece of the packaging sheet around the first end of the web roll to form end packaging that covers the inner tip and has a substantially uniformly shaped axial projection.

2. A method for packaging a web roll in accordance with claim 1, further comprising wrapping the packaging sheet in a circumferential direction around the second end of the web roll to form end packaging that has a substantially uniformly shaped axial projection.

3. A method for packaging a web roll in accordance with claim 1, wherein an inner edge of the end packaging extends longitudinally inside the inner tip by a width of up to about 20 percent of the width of the packaging sheet.

4. A method for packaging a web roll in accordance with claim 1, the circumferential wrapping comprising covering the outer tip of the packaging sheet.

5. A method for packaging a web roll in accordance with claim 1, further comprising preparing the axial tip projection to be free of glue.

6. A method for packaging a web roll in accordance with claim 5, further comprising applying glue in several parallel strips on the packaging sheet, wherein the glue strips are not applied in the vicinity of the axial tip projection.

7. A method for packaging a web roll having first and second ends and a longitudinal axis, comprising:

guiding a packaging sheet at an angle oblique to the longitudinal axis the packaging sheet having an end with an outer tip and an inner tip formed by a separating line;

positioning the outer tip beyond the first end of the web roll to form an axial tip projection;

helically wrapping the packaging sheet around the web roll to form body packaging;

circumferentially wrapping a separate piece of the packaging sheet around the first end of the web roll to form end packaging that covers the inner tip and has a substantially uniformly shaped axial projection;

applying a glue that dries in air after a predetermined period of time on the axial tip projection; and wrapping the axial tip projection on a face of the web roll only after the predetermined period of time has elapsed.

8. A method for packaging a web roll in accordance with claim 7, the predetermined period of time being at least as long as the time required to form the end packaging on the first and second ends of the web roll.

9. A method for packaging a web roll in accordance with claim 1, further comprising positioning the inner tip of the packaging sheet on the web roll.

10. A method for packaging a web roll with a packaging web having a first end and the web roll having first and second ends and a longitudinal axis, the method comprising:

positioning a portion of the first end of the packaging web over the web roll and a remaining portion of the first end axially outside of the first end of the web roll;

helically wrapping the web roll with the packaging web from the packaging web supply;

creating a first tip with a separating line and positioning the first tip over the web roll and creating a second tip with the separating line and positioning the second tip axially outside of the second end of the web roll; and circumferentially wrapping the web roll with a separate piece of the packaging web at one of the first and the second end of the web roll, wherein the circumferential wrapping completely covers the one of the first and the created first and second tips of the packaging web.

11. The method in accordance with claim 10, further comprising:

circumferentially wrapping the packaging web at the other of the first and the second end of the web roll, wherein the circumferential wrapping completely covers the other of the first and the second end of the packaging web.

* * * * *